US005393726A

United States Patent [19]

Graumann

[11] Patent Number: 5,393,726

[45] Date of Patent: Feb. 28, 1995

[54] DYE DIFFUSION THERMAL TRANSFER CARRIER MATERIAL

[75] Inventor: Jurgen Graumann, Osnabruck, Germany

[73] Assignee: Felix Schoeller jr. Papierfabriken GmbH & Co. KG, Osnabruck, Germany

[21] Appl. No.: 128,485

[22] Filed: Sep. 28, 1993

[30] Foreign Application Priority Data

Oct. 1, 1992 [DE] Germany ..... 4233018

[51] Int. Cl.[6] ..... B41M 5/035; B41M 5/38

[52] U.S. Cl. ..... 503/227; 428/206; 428/211; 428/318.4; 428/327; 428/341; 428/342; 428/402; 428/513; 428/913; 428/914

[58] Field of Search ..... 8/471; 428/197, 206, 428/318.4, 913, 914, 211, 327, 341, 342, 402, 513; 503/227

[56] References Cited

U.S. PATENT DOCUMENTS 5,001,106 3/1991 Egashira et al. ..... 503/227
5,071,823 12/1991 Matsushita et al. ..... 503/227

FOREIGN PATENT DOCUMENTS 3934014 4/1990 Germany ..... 503/227

*Primary Examiner*—B. Hamilton Hess
*Attorney, Agent, or Firm*—Lockwood, Alex, Fitzgibbon & Cummings

[57] ABSTRACT

A dye diffusion thermal transfer carrier material comprises a base material and an intermediate layer which contains a film forming binder with a minimum film forming temperature of at least 25° C., and a pigment of hollow polymer micropellets in which the micropellets have an interior space that has a volume that is between 10 and 55% of the total volume of the micropellet body.

15 Claims, No Drawings

DYE DIFFUSION THERMAL TRANSFER CARRIER MATERIAL

BACKGROUND AND DESCRIPTION OF INVENTION

The present invention relates to a carrier material for receiving material for dye diffusion thermal transfer (D2T2), which comprises a carrier and an intermediate layer.

In recent years a method of dye diffusion thermal transfer has been developed which makes possible the reproduction of an electronically produced picture in the form of a "hardcopy." The principle of such a method is as follows. A digital picture is prepared with respect to the basic colors cyan, magenta, yellow and black and it is converted to the corresponding electronic signals, which then are converted into heat by a thermohead. Due to the effects of the heat, the dye sublimes out of the donor coating of a color strip or sheet that is in contact with the receiving material and the dye diffuses into a receptor layer.

The receiving material for the thermal dye transfer as a rule consists of a carrier with a receptor layer applied to its front side. Aside from the receptor layer, other layers are often also applied to the front side of the carrier. These include, for example intermediate layers, such as barrier, separation and adhesive layers among others, or protective layers. Plastic film, for example polyester film or a coated paper, can be used as carriers.

The principal component of the receptor layer as a rule, is a thermoplastic resin that has an affinity for dye from the color ribbon. Plastics with ester compounds can be used for this, for example polyester resins, polyacrylate resins, polycarbonate resins, polyvinyl acetate resins and styrene acrylate resins, plastics with amide bonds, for example polyamide resins, as well as mixtures of the resins listed. However, copolymers that have at least one of the above named structures as a principal component, for example vinyl chloride/vinyl acetate copolymer, may also be used.

To obtain pictures with higher quality with respect to optical density, color tone (reproducibility of graduation) and resolution, the following requirements are set for the receiving material:

smooth surface;
heat stability;
light stability;
good dye solubility;
good resistance to scratching and rubbing;
"anti-blocking" characteristics (no sticking).

It is known that in spite of achieving the above named qualities, qualitatively inferior pictures can occur which can be traced to an insufficient contact of the thermohead on the opposing transport roller in the printer, and which results in unprinted portions. To prevent this effect, a further requirement is set for the receiving material, which requirement is a so-called softness. A soft, smearable receiving material can, for example, be produced by applying an intermediate coating that fulfills the function of a cushion coating.

This problem is supposedly solved in JP 62-146693 by the application of a cushion layer consisting of styrene/-butadiene or vinyl acetate latex.

In another patent JP 02-274592 an intermediate layer of foamy polypropylene is applied.

The same problem is supposed to have been solved in another patent JP 03-092382 by the application of a microporous resin intermediate layer.

Furthermore, to include a pellet shaped filler, such as polypropylene, in a cushion layer, is known from JP 03-110195.

In DE 3,934,014, a receiving material is proposed in which a porous heat insulated layer that contains macromolecular micropellets in the form of hollow resin particles and/or heterogeneous resin particles is applied to a substrate.

The disadvantage of this receiving material is the porosity of the intermediate coating. Because of this porosity, dye can leak out of the receptor layer into the interior of the base sheet, and the transferred picture appears blurry.

The objective of the invention comprises making available a carrier material for a receiving material for the thermal sublimation process which, independent of the type and composition of the image receptor layer makes possible the printing of pictures with high color density and resolution with an even distribution of the dye on the surfaces and without unprinted portions.

This objective is attained by means of an intermediate layer which contains a film forming binder with a minimum film forming temperature (MFFT) of at least 25° C. and a pigment in the form of hollow polymer micropellets in which the micropellets have an interior space that has a volume that is between 10 and 55% of the total volume of the pellet body. Particularly suitable are micropellets whose interior volume is 12.5–25% of the total pellet body.

The hollow micropellets have a diameter of 0.4–1 μm, and preferably 0.4–0.6 μm.

The intermediate layer according to the invention is applied to a base paper coated with polyolefin, in particular, a base paper coated with polyethylene or polypropylene.

The material of the micropellets is selected from styrene, acrylic, and/or styrene/acrylic copolymer resins.

Contrary to the effect that would be anticipated, it has been surprisingly shown that with a quantity of 4–30 wt % of micropellets in the intermediate layer, a high resolution of the pictures transferred, as well as their even appearance without unprinted portions, can be obtained.

Furthermore, by the use of the micropellets according to the invention, a good opacity of the material coated with the intermediate layer is obtained, which opacity also hides the usual markings on the back side.

By the use of the intermediate layer according to the invention, a good barrier effect is obtained between the receptor layer and the paper carrier coated with polyolefin. In this way, during the effects of the heat, dyes do not diffuse into the paper base and are not carried farther by materials from the polyolefin coating, which would result in a blurry appearance of the picture.

The film forming binder used in the intermediate layer according to the invention with a minimum film forming temperature of at least 25° C. is a resin that is soluble in organic solvents and which resin is from the group of acrylonitrile, acrylate, vinyl chloride, vinyl acetate, vinylidene chloride, polyamide, urethane homopolymers or copolymers as well as mixtures of these resins. Aside from the listed binders, a mixture that always contains polyvinylidene chloride, such as a mixture of acrylate copolymer and polyvinylidene chloride, and whose minimum film forming temperature is approximately 26° C. has been shown to be particularly advantageous.

Furthermore, the intermediate layer can also contain other additives, such as dispersing agents, release agents, dyes and other additives.

The intermediate coating is applied to the carrier as an aqueous dispersion using any useful application and metering procedures, such as for example doctor blades, rollers, brushes, gravure or nip processes, and is subsequently dried. The coating weight of the dried layer is 0.5–50 g/m$^2$ and preferably 2–10 g/m$^2$.

In a particular embodiment of the invention, a layer is applied to the back side of the receiving material to prevent the imprinting of the picture on the back side of the material. This back side layer can contain binders, such as starch, gelatin, and other adjuvants, such as pigments.

The invention will be explained using the following examples.

EXAMPLE 1

For the coating, a base paper coated on both sides with polyethylene is used. The paper is characterized by:

| | | | |
|---|---|---|---|
| Basis weight: 180 g/cm$^2$ | | | |
| PE front side: | | | |
| LDPE | d = 0.924 g/cm$^3$ | | 32.2 wt % |
| HDPE | d = 0.950 g/cm$^3$ | | 50.0 wt % |
| $TiO_2$ master batch | MFI = 8.5 | | 15.0 wt % |
| Color master batch: | | | |
| 10% | Ultramarine blue + 90% LDPE | MFI = 5 | 1.7 wt % |
| 40% | Cobalt blue + 60% LDPE | MFI = 12 | 1.1 wt % |
| Coating weight: 17.5 g/m$^2$ | | | |
| PE back side: | | | |
| LDPE | d = 0.915 | MFI = 8.0 | 25 wt % |
| LDPE | d = 0.923 | MFI = 4.4 | 33 wt % |
| HDPE | d = 0.950 | MFI = 7.0 | 42 wt % |
| Coating weight: 17.5 g/m$^2$ | | | |

The front side of the base paper described above is coated with an aqueous dispersion of the following composition and subsequently dried:

| | Composition, wt % | | | | | |
|---|---|---|---|---|---|---|
| Components | 1a | 1b | 1c | 1d | 1e | 1f |
| Vinyl chloride/vinyl acetate, 50% solution in water, MFFT = 26° C. (30 parts Vinnol 50 + 70 parts Vinnol 50/25C) | 95 | 95 | 70 | 50 | 95 | 95 |
| Hollow micropellets with an interior volume/total volume ratio of: | | | | | | |
| Type A Approximately 13%, 40% solution in water | 5 | 5 | 30 | 50 | — | — |
| Type B Approximately 22%, 40% solution in water | — | — | — | — | 5 | — |
| Type C Approximately 51%, 40% solution in water | — | — | — | — | — | 5 |
| Coating weight, g/m$^2$ | 4 | 8 | 8 | 8 | 8 | 8 |

Other test conditions
Machine speed: 130 m/min
Drying temperature: 110° C.
Drying time: 10 sec A receptor layer is applied to the material provided with the described intermediate layer. The receptor layer has the following composition:

| | |
|---|---|
| Vinyl chloride/vinyl acetate 50% solution in water | 50 wt % |
| Vinyl chloride/methyl acrylate 50% solution in water | 50 wt % |

The coating weight of the receptor layer was 6 g/m$^2$.

The receiving material obtained in this way was printed using the thermal image transfer method and subsequently was analyzed. The results are summarized in Table I.

EXAMPLE 2

A base paper coated with polyethylene as in Example 1 was coated with an aqueous dispersion of the following composition:

| | Composition wt % | |
|---|---|---|
| Components | 2a | 2b |
| Acrylate copolymer, 40% solution in water, MFFT = 30° C. (Primal HG 44, Rohm & Haas) | 95 | 70 |
| Polyvinylidene chloride, 55% solution in water, MFFT = 18° C. (Diofan 233 D, BASF) | — | 25 |
| Hollow micropellets, Type A | 5 | 5 |
| Coating weight, g/m$^2$ | 8 | 8 |

The carrier materials produced in these ways were coated with a receptor layer as in Example 1 and subsequently were printed and analyzed. The results are summarized in Table I.

EXAMPLE 3

A base paper coated with polypropylene was coated with an aqueous dispersion of the following composition:

| | |
|---|---|
| Vinyl chloride/vinyl acetate 50% solution in water MFFT = 26° C. (30 parts Vinnol 50 + 70 parts Vinnol 50/25C) | 95 wt % |
| Hollow micropellets Type A 40% solution in water | |

The coating weight was 8 g/m$^2$, relative to the dry weight of the layer.

The carrier material was also provided with a receptor layer as in Example 1, and then was printed and analyzed. The results are summarized in Table I.

The carrier materials produced according to Examples 1–3 were also coated with other receptor layers. The test results corresponded in their statements to the results that were obtained using the receptor layer described in Example 1.

COMPARATIVE EXAMPLES V1 and V2

A base paper coated with polyethylene was coated as in Example 1 with the following dispersion:

| Components | Composition, wt % V1 | V2 |
|---|---|---|
| Acrylate copolymer, 40% solution in water, MFFT = 30° C. (Primal HG 44, Rohm & Haas) | — | 5 |
| Ethylene/vinyl acetate/vinyl chloride, 50% solution in water, MFFT = 7° C. (Vinnapas CEF 10, Wacker Co.) | 95 | — |
| Micropellets, Type A | 5 | 95 |
| Coating weight, g/m$^2$ | 8 | 8 |

The carrier materials produced in these ways were coated with a receptor layer as in Example 1 and subsequently were printed and analyzed. The results are summarized in Table I.

Testing of the Receiving Material Obtained According to the Examples and the Comparative Examples The receiving materials were subjected to a thermal image transfer process.

For this a color video printer VY-25E of the Hitachi Co., that used a Hitachi color ribbon, was used. The video printer has the following data:

Video memory: PAL 1-full image memory

Printing image: 64 color tone image Image elements: 540:620 dots

Printing time: 2 min/print

Color density and line sharpness were measured for the printed receiving material (hardcopy). Furthermore, the appearance (mottle and topping effect) of the printed material was assessed visually.

Density measurements were done using the original reflection densitometer SOS-45. The measurements were done for the basic colors, cyano, magenta and yellow. In the table, the average value of the densities of all three colors is given.

Line sharpness (resolution) was determined by the test prints printed in the basic colors. The test print shows straight lines, which are printed both horizontally and vertically. The measurement was done with a thread counter at three measuring points. An arithmetic mean was calculated from this. The smaller the measured value of the line width, the higher the sharpness of the picture.

The same measurements of line sharpness were conducted after the samples had been subjected to a quick aging test. For this, the samples were left in a drying cabinet at 75° C. for 24 hours.

The word "mottle" is used for an effect that is expressed by a cloudiness of the appearance of the printed material. It is evaluated with a grading scale of 1–5 in an internal test using reference prints, in which grade 1 is given for a very even appearance of the printed material and grade 5 is given for a very cloudy appearance of the printed material.

Also using reference pictures, the so called "topping" effect is assessed visually. By "topping" is meant unprinted white points in the image, which are produced by an insufficient contact of the thermohead with the opposing transport roller in the printer. Grade 1 stands for an evenly printed material, and grade 5, on the contrary, for a material with many unprinted spots.

The results summarized in Table I show that when using the carrier materials according to the invention, receiving material that has good printability (see "mottle" and "topping"), and printed images with high color density and resolution can be produced.

TABLE I

Qualities of Carrier Materials Printed and Produced According to Examples 1-3 and Comparative Examples V1 and V2

| Example | Color density | Mottle (grade 1–5) | Topping (grade 1–5) | Line sharpness S mm | S' mm |
|---|---|---|---|---|---|
| 1a | 1.46 | 1 | 2 | 0.25 | 0.45 |
| 1b | 1.48 | 1 | 2 | 0.25 | 0.45 |
| 1c | 1.42 | 2 | 4 | 0.30 | 0.50 |
| 1d | 1.36 | 3 | 4.5 | 0.35 | 0.55 |
| 1e | 1.44 | 1 | 3 | 0.35 | 0.55 |
| 1f | 1.47 | 2 | 3 | 0.35 | 0.50 |
| 2a | 1.52 | 1 | 2 | 0.25 | 0.40 |
| 2b | 1.48 | 1 | 2 | 0.25 | 0.25 |
| 3 | 1.48 | 1 | 2 | 0.25 | 0.40 |
| V1 | 1.42 | 3 | 5 | 0.40 | 0.70 |
| V2 | 1.59 | 5 | 2.5 | 0.40 | 0.75 |

S1' = Line width, measured according to quick aging test

I claim:

1. A dye diffusion thermal transfer carrier material for carrying a dye receptor layer, comprising:

a base material; and a layer on said base material which is adapted to receive the receptor layer thereon and which contains a film forming binder with a minimum film forming temperature of at least 25° C., and a pigment in the form of hollow polymer micropellets in which the micropellets have an interior space with a volume that is between about 10 and 55% of the total volume of the micropellet body, and wherein the amount of said micropellets in said layer is about 4–30 wt %.

2. The carrier material of claim 1, wherein the volume of the interior space of the micropellets is about 12.5–25% of the total volume of the micropellet body.

3. The carrier material of claim 2, wherein the hollow micropellets have a diameter of about 0.4–1 μm.

4. The carrier material of claim 1, wherein the hollow micropellets have a diameter of about 0.4–1 μm.

5. The carrier material of claim 1, wherein the hollow polymer micropellets are selected from the group consisting of styrene, acrylic, styrene/acrylic copolymer resins and mixtures thereof.

6. The carrier material of claim 1, wherein the binder is a resin selected from the group consisting of polyacrylonitrile, polyvinyl chloride, polyvinyl acetate, polyvinylidene chloride, polyamide, melamine, polyurethane resins and mixtures thereof.

7. The carrier material of claim 6, wherein the binder is a mixture containing polyvinylidene chloride.

8. The carrier material of claim 1, wherein the base material is paper coated with a polyolefin.

9. The carrier material of claim 1, wherein the coating weight of the layer is about 0.5–50 g/m$^2$.

10. The carrier material of claim 9, wherein the coating weight of the layer is about 2–10 g/m$^2$.

11. The carrier material of claim 1, including a receptor layer applied to the layer.

12. The carrier material of claim 1, wherein the hollow polymer micropellets are selected from the group consisting of styrene, acrylic, styrene/acrylic copolymer resins and mixtures thereof; the binder is a resin selected from the group consisting of polyacrylonitrile, polyvinyl chloride, polyvinyl acetate, polyvinylidene chloride, polyamide, melamine, polyurethane resins and mixtures thereof; and the coating weight of the layer is about 0.5–50 g/m$^2$.

13. The carrier material of claim 12, wherein the base material is paper coated with a polyolefin.

14. The carrier material of claim 13, including a receptor layer applied to the layer.

15. The carrier material of claim 12, including a receptor layer applied to the layer.

* * * * *